US007182718B2

(12) United States Patent
Wu

(10) Patent No.: US 7,182,718 B2
(45) Date of Patent: Feb. 27, 2007

(54) MUSCLE EXERCISING DEVICE

(75) Inventor: Shen Yi Wu, Taichung (TW)

(73) Assignee: Strength Master Health Corp., Taichung (TW)

( * ) Notice: Subject to any disclaimer, the term of this patent is extended or adjusted under 35 U.S.C. 154(b) by 0 days.

(21) Appl. No.: 11/180,664

(22) Filed: Jul. 14, 2005

(65) Prior Publication Data

US 2007/0015638 A1 Jan. 18, 2007

(51) Int. Cl.
*A63B 21/02* (2006.01)

(52) U.S. Cl. ..... 482/122; 482/121

(58) Field of Classification Search ..... 482/122, 482/126–128, 114–118, 72
See application file for complete search history.

(56) References Cited

U.S. PATENT DOCUMENTS 4,022,463 A * 5/1977 Scott, Jr. ..... 482/122
4,564,192 A * 1/1986 Lebowitz ..... 482/87
5,507,712 A * 4/1996 Chang ..... 482/126
5,674,164 A * 10/1997 Kravitz ..... 482/126
6,364,816 B1 * 4/2002 Tang et al. ..... 482/126
7,008,354 B2 * 3/2006 Wen ..... 482/127
2004/0142798 A1 * 7/2004 Liao et al. ..... 482/126

* cited by examiner

*Primary Examiner*—Stephen R. Crow
*Assistant Examiner*—Allana Lewin
(74) *Attorney, Agent, or Firm*—Rosenberg, Klein & Lee

(57) ABSTRACT

A muscle exercising device includes a body with two pivotable members pivotably connected to two sides of the body and each pivotable member has an arm connected thereto. Each of the two pivotable members has a first pressing portions and a second pressing portion, both of the two pressing portions are in contact with two outsides of a resilient member connected between the two pivotable members. A sliding member is slidably connected to the body and the resilient member is connected to and movable together with the sliding member. The users pivot the two arms to compress the resilient member to exercise muscles.

9 Claims, 7 Drawing Sheets

MUSCLE EXERCISING DEVICE

FIELD OF THE INVENTION

The present invention relates to a muscle exercising device with compact size and for exercising muscles of arms and thighs.

BACKGROUND OF THE INVENTION

A conventional muscle exercising device is designed to exercise specific parts of the user's body by repeatedly operating arms (for example) to reinforce the muscles. Generally, weights are applied to increase the weight in vertical direction so that the muscles are exercised to lift the weights. Another type of the load is applied by rubber bands which have different bouncing forces and the users have to expand the rubber bands to exercise the muscles. In other words, the conventional muscle exercising devices have to be bulky for provide sufficient space for the weights or rubber bands. This is inconvenient for storage and for small gyms.

SUMMARY OF THE INVENTION

The present invention relates to a muscle exercising device which includes a body having a first end and a second end located along an axial axis of the body. Two pivotable members are pivotably connected to two sides of the body and each pivotable member has a first pressing portion and a second pressing portion located on an inside thereof. A resilient member is connected between the two pivotable members and includes two contact surfaces so that the two respective first pressing portions and second pressing portions are respectively in contact with the two contact surfaces. Two arms are connected to the two pivotable members respectively so as to pivot the two pivotable members to compress the resilient member.

The present invention intends to provide a muscle exercising device that has a compact size and adjustable function to meet different needs of users.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
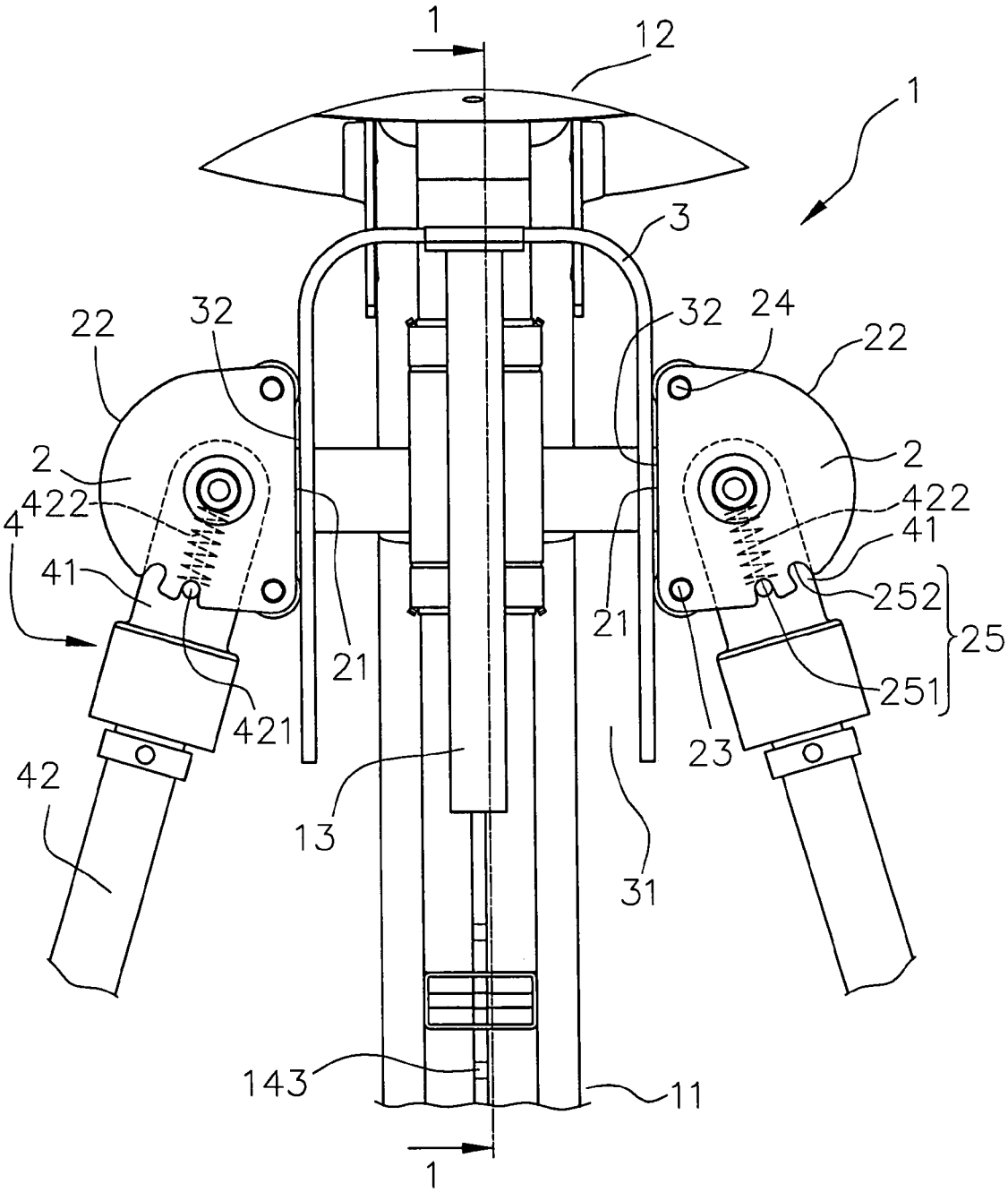
FIG. 1 is top view of the exercising device of the present invention.
Figure 2:
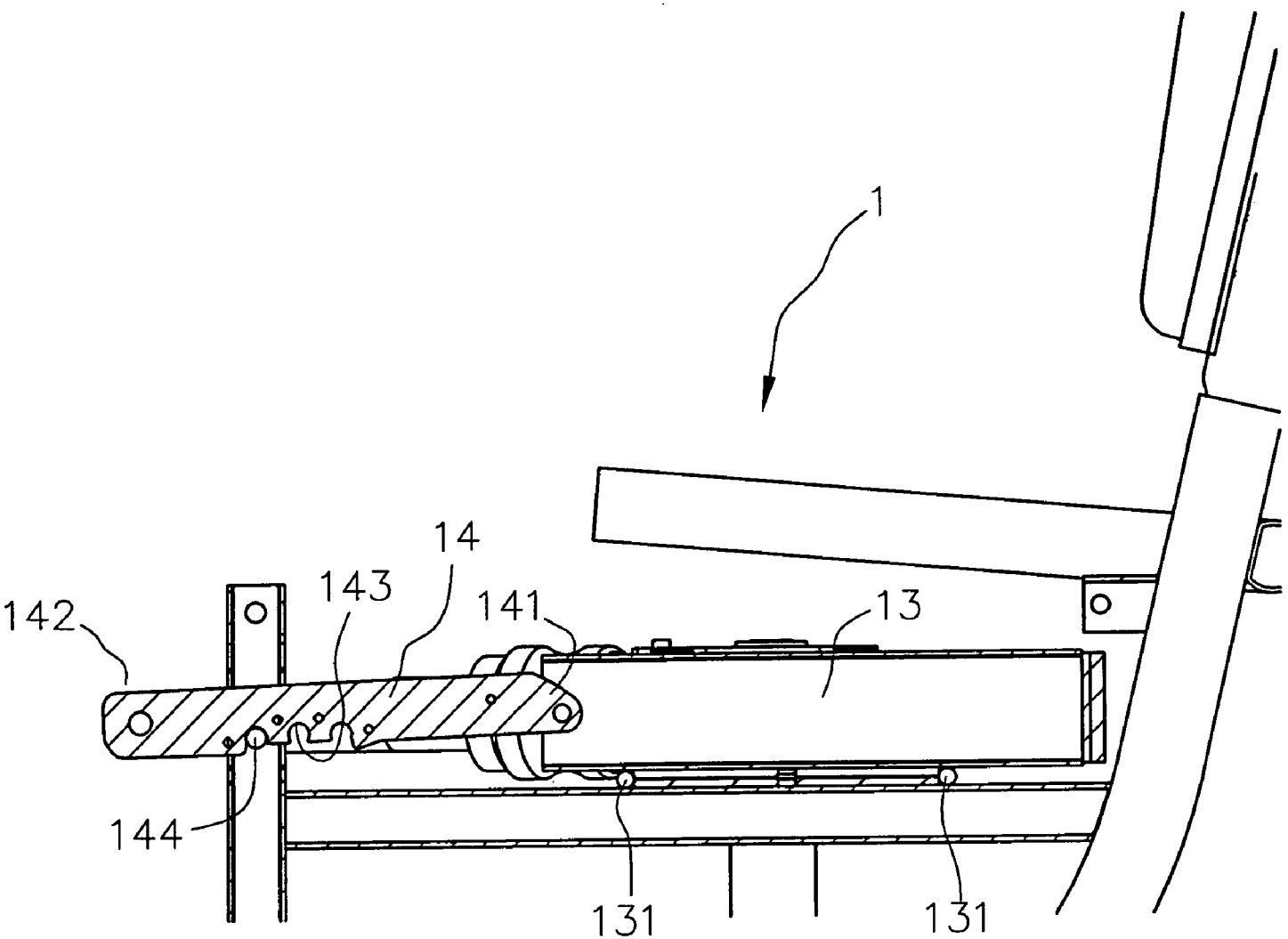
FIG. 2 is a cross sectional view along line 1—1 in FIG. 1.

Referring to FIGS. 1 and 2, the muscle exercising device of the present invention comprises a body 1 having a first end 11 and a second end 12 located along an axial axis of the body 1. A sliding member 13 is slidably connected to the body 1 and a U-shaped resilient member 3 is connected to the sliding member 13, wherein the open end 31 of the U-shaped resilient member 3 faces the first end 11 of the body 1. The sliding member 13 includes two rollers 131 which are in contact with the body 1 so as to allow the sliding member 13 to slide relative to the body 1. The sliding member 13 is connected with an operation member 14 which includes a connection end 141 for being connected with the sliding member 13 and an operation end 142. There are a plurality of notches 143 defined in the operation ember 14 and located along the axial direction of the body 1. A rod 144 extending from the body 1 is engaged with one of the notches 143 to position the operation member 14 which is then not disengaged from the body 1.

Two pivotable members 2 are pivotably connected to two sides of the body 1 and each pivotable member 2 has an inside 21 and an outside 22. A first pressing portion 23 and a second pressing portion 24 are located on the inside 21 of each pivtoable member 2. The resilient member 3 is connected between the two pivotable members 2 and includes two contact surfaces 32 so that the two respective first pressing portions 23 and second pressing portions 24 are respectively in contact with the two contact surfaces 32.

Two arms 4 are connected to the two pivotable members 2 respectively such that when the users pivot the arms 4, the two pivotable members 2 are pivoted about a pivot in their center and compress the U-shaped resilient member 3. Each of the pivotable members 2 has a first positioning device 25 which includes a plurality of notches 251, 252. Each of the arms 4 has a base end 41 which is pivotably connected to the pivotable member 2 corresponding thereto and a handle 42 extends from the base end 41. Each handle 42 of the two arms 4 includes a second positioning device 421 which is a rod and engaged with one of the notches 251, 252 of the first positioning device 25 to position the angle of the arm 4 relative to the pivotable member 2. A spring member 422 is connected between the base end 41 and the pivotable member 2 so as to pull the base end 41 and the pivotable member 2 together.

Figure 3:
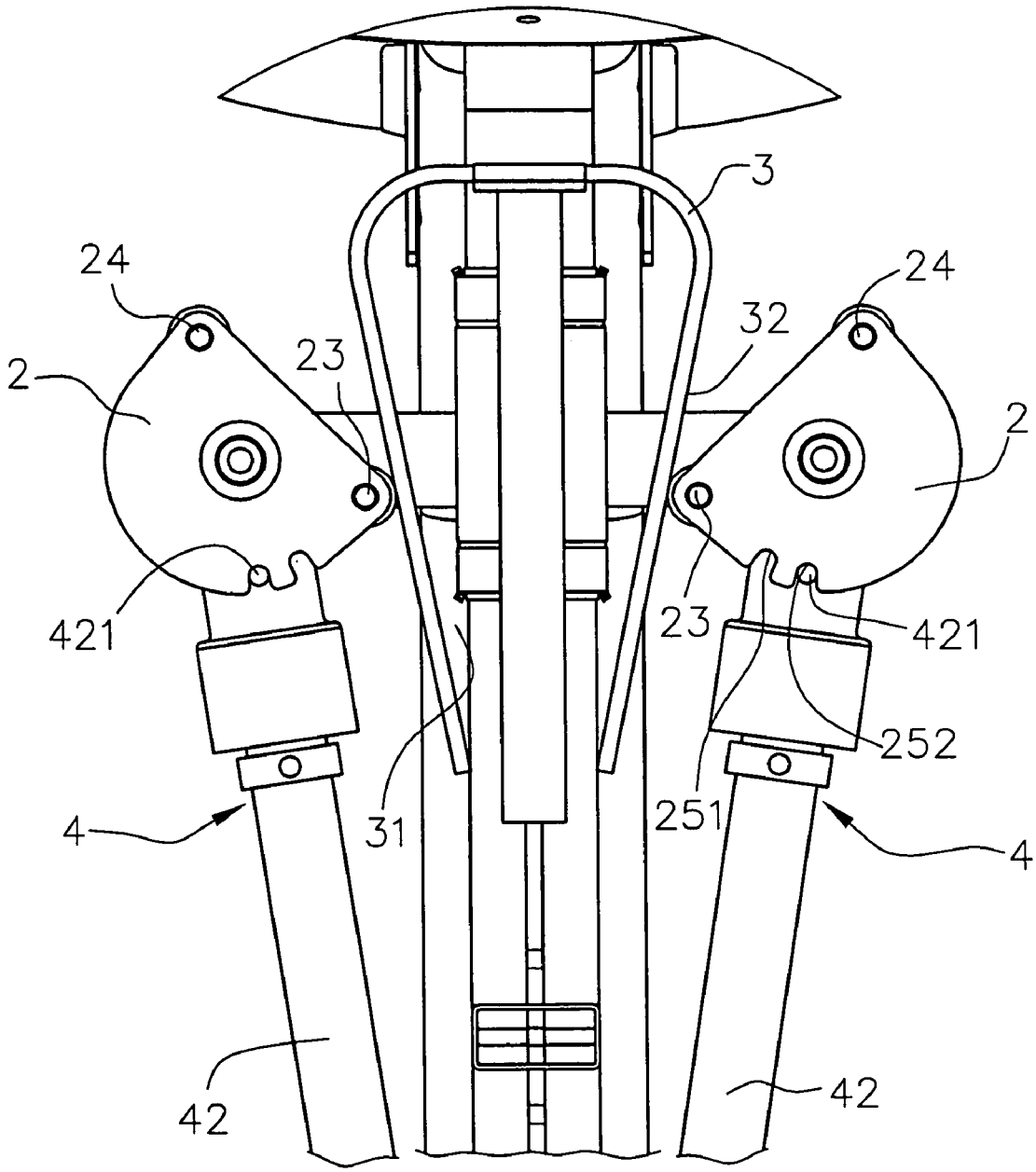
FIG. 3 shows the two arms are pivoted to let the first pressing portions squeeze the resilient member.
Figure 4:
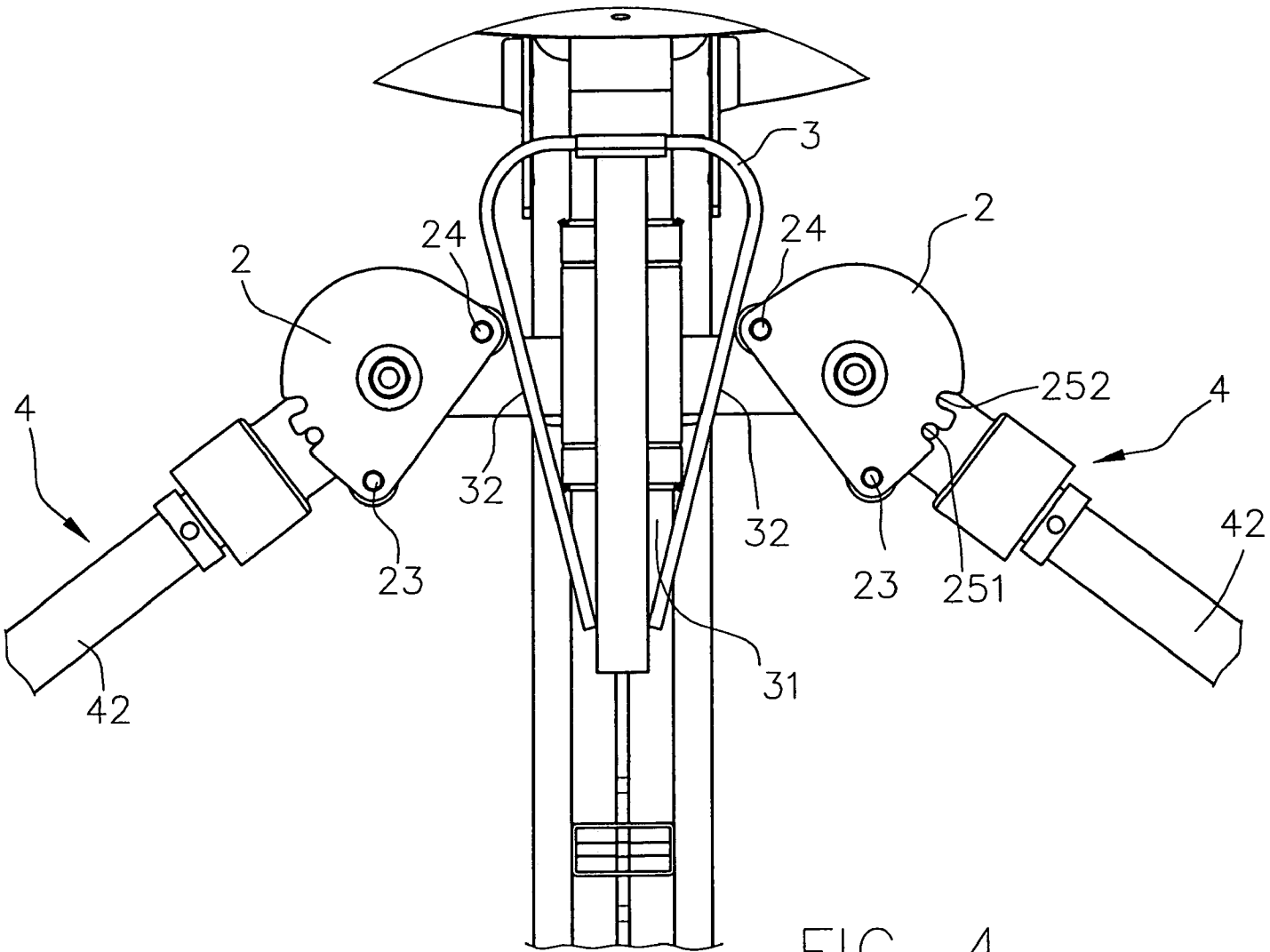
FIG. 4 shows the two arms are pivoted to let the second pressing portions squeeze the resilient member.

A shown in FIGS. 3 and 4, the users may pivot the arms 4 relative to the pivotable members 2 to repeatedly and alternatively compress the resilient member 3 by the first and second pressing portions 23, 24. The users have to overcome the resistant force of the resilient member 3 to exercise their muscles. The rod of the second positioning device 421 can be selectively engaged with either the notch 251 or notch 252 to adjust the angular distance that the arms 4 can go.

Figure 5:
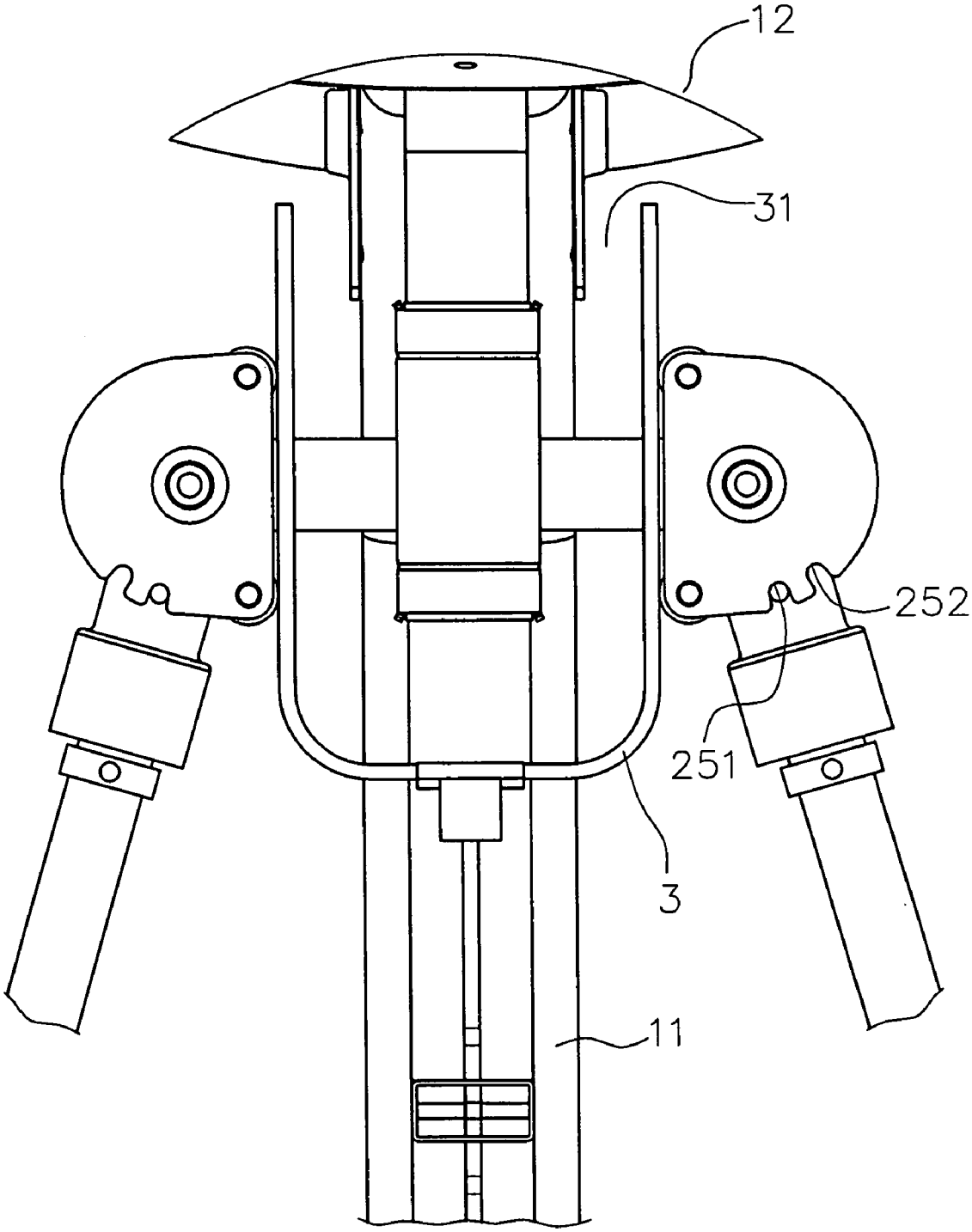
FIG. 5 shows another embodiment of the resilient member.
Figure 6:
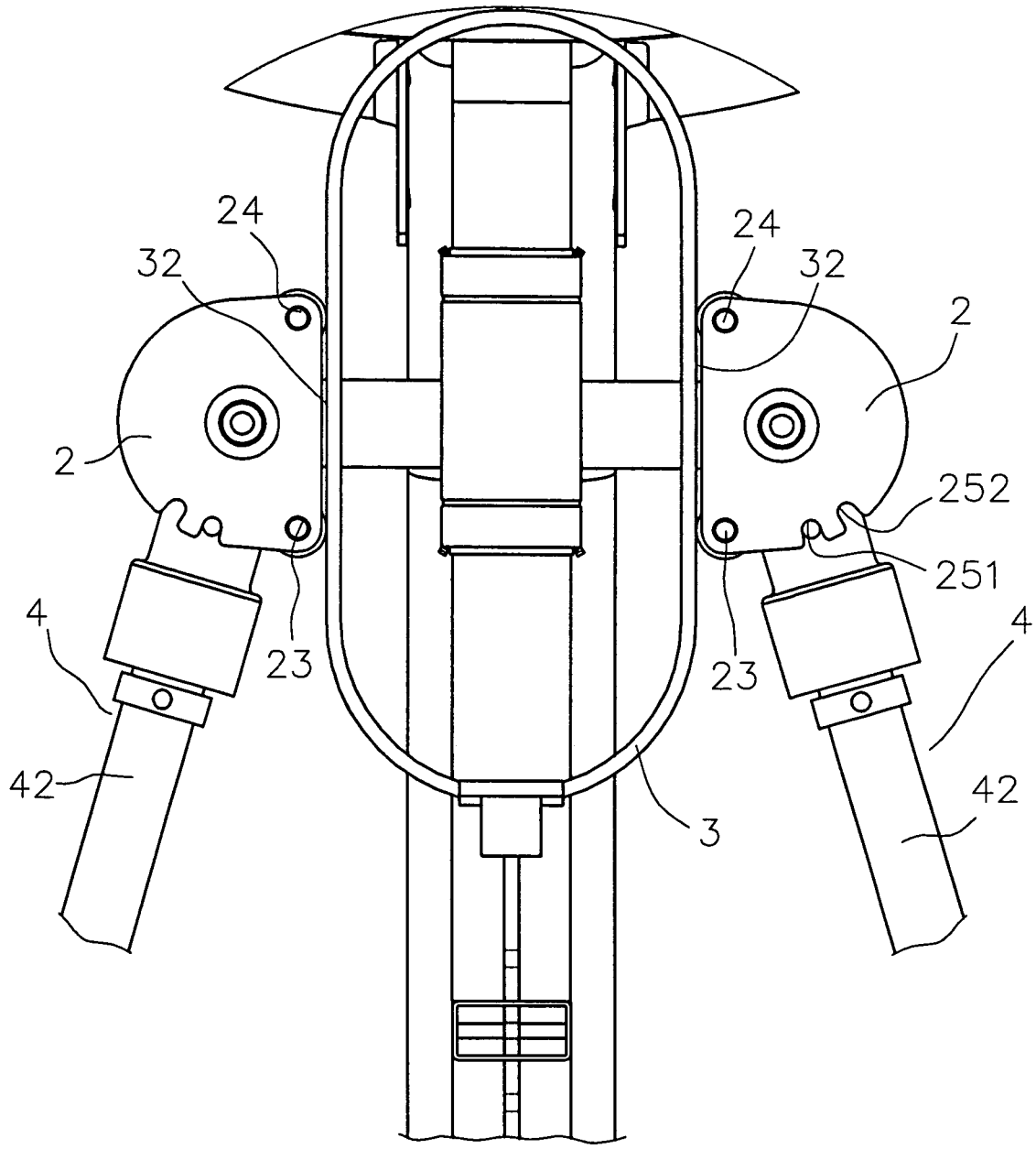
FIG. 6 shows yet another embodiment of the resilient member.

FIGS. 5 and 6 show two embodiments of the resilient member 3, wherein the resilient member 3 in FIG. 5 is a U-shaped member and the open end 31 faces the second end 12 of the body 1. The resilient member 3 in FIG. 6 is an enclosed loop.

Figure 7:
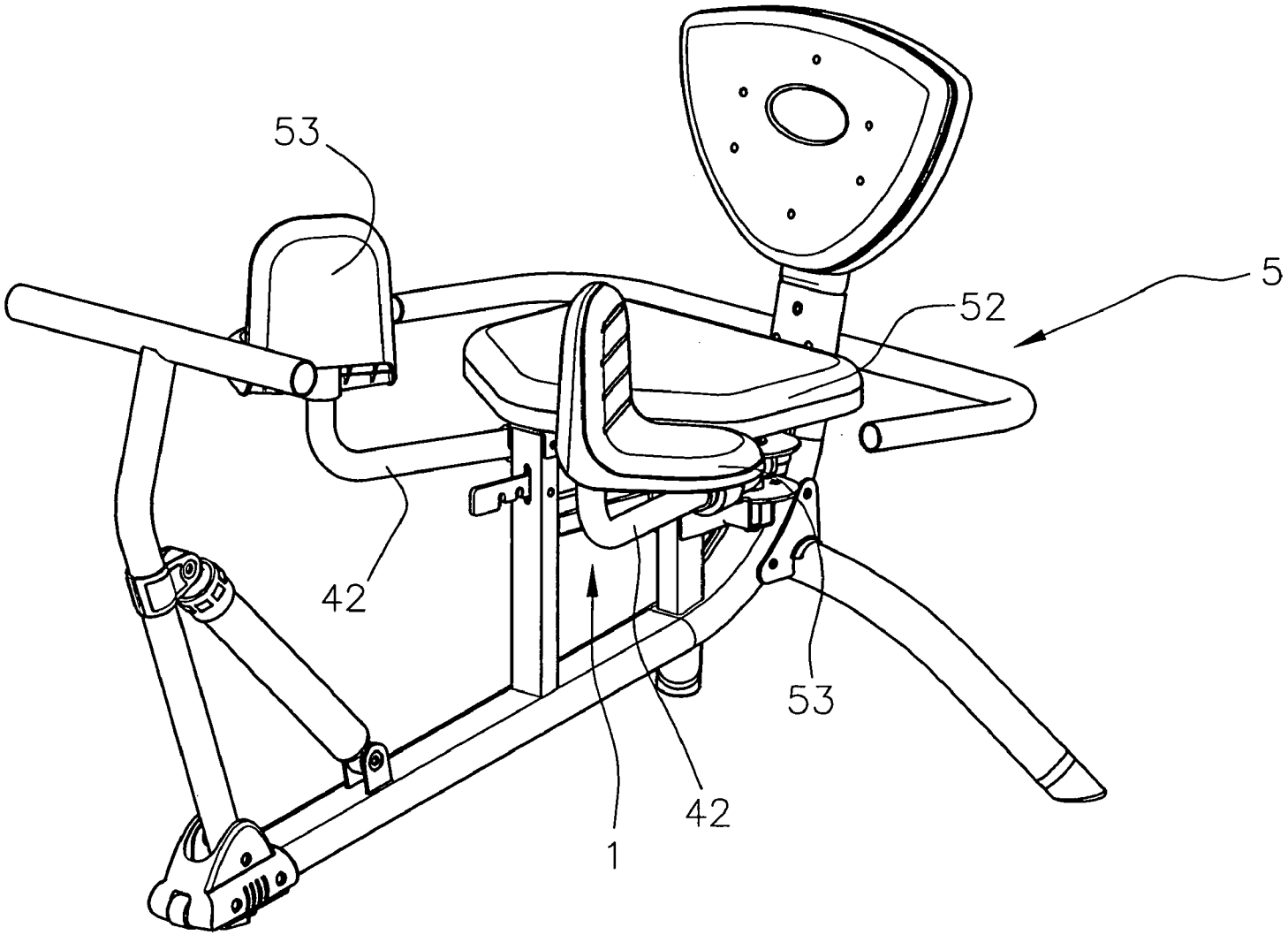
FIG. 7 shows a perspective view to show an embodiment of a muscle exercising device for training muscles of thighs.

The muscle exercising device can be used with different types of training machines, as shown in FIG. 7 is a muscle exercising device 5 for training muscles of thighs and includes a seat 52 and the two arms 42 are connected with two respective support members 53 on which feet are put thereon. The feet then push the two arms 42 outward to compress the resilient member to train the muscles of thighs.

While we have shown and described the embodiment in accordance with the present invention, it should be clear to those skilled in the art that further embodiments may be made without departing from the scope of the present invention.

What is claimed is:

1. A muscle exercising device comprising:

a body having a first end and a second end located along an axial axis of the body;

two pivotable members pivotably connected to two sides of the body and each pivotable member having an inside and an ouside, a first pressing portion and a second pressing portion located on the inside of each pivotable member;

a resilient member connected between the two pivotable members and including two contact surfaces so that the two respective first pressing portions and second pressing portions are respectively in contact with the two contact surfaces;

two arms connected to the two pivotable members respectively so as to pivot the two pivotable members; and wherein each of the pivotable members has a first positioning device and each of the arms has a base end which is pivotably connected to the pivotable member corresponding thereto and a handle extends from the base end, each handle of the two arms includes a second positioning device which is engaged with the first positioning device, a spring member is connected between the base end and the pivotable member so as to pull the base end and the pivotable member together.

2. The device as claimed in claim 1, wherein a sliding member is slidably connected to the body and the resilient member is connected to the sliding member.

3. The device as claimed in claim 2, wherein the sliding member includes at least one roller which is in contact with the body.

4. The device as claimed in claim 2, wherein the sliding member is connected with an operation member which includes a connection end for being connected with the sliding member and an operation end.

5. The device as claimed in claim 1, wherein the resilient member is a U-shaped member and includes an open end.

6. The device as claimed in claim 5, wherein the open end of the resilient member faces the first end.

7. The device as claimed in claim 5, wherein the open end of the resilient member faces the second end.

8. The device as claimed in claim 1, wherein the resilient member is an enclosed loop.

9. The device as claimed in claim 1, wherein the first positioning device includes a plurality of notches and the second positioning device is a rod which is engaged with one of the notches.

* * * * *